US005441248A

United States Patent [19]

Kristola

[11] Patent Number: 5,441,248

[45] Date of Patent: Aug. 15, 1995

[54] FEEDING MECHANISM

[75] Inventor: Jay L. Kristola, 21222 Newton Rd., Kiel, Wis. 53042

[73] Assignee: Jay L. Kristola, Kiel, Wis.

[21] Appl. No.: 242,238

[22] Filed: May 13, 1994

[51] Int. Cl.[6] ..... B65H 5/08

[52] U.S. Cl. ..... 271/12; 271/94; 271/99; 271/104; 271/165

[58] Field of Search ..... 271/12, 13, 94, 99, 271/104, 112, 119, 121, 165, 171

[56] References Cited

U.S. PATENT DOCUMENTS

| | | | |
|---|---|---|---|
| 3,291,482 | 12/1966 | Stemmler | 271/94 |
| 3,726,454 | 4/1973 | Robbins | 271/184 |
| 3,976,291 | 8/1976 | Bernardi et al. | 271/94 |
| 3,998,449 | 12/1976 | Hornung . | |
| 4,184,670 | 1/1980 | Rosendahl . | |
| 4,269,405 | 5/1981 | Mitzel | 271/112 |
| 4,324,394 | 4/1982 | Mitzel et al. | 271/104 |
| 4,345,752 | 8/1982 | Nakamura et al. | 271/94 |
| 4,712,783 | 12/1987 | Selak | 271/171 |
| 4,758,126 | 7/1988 | Johnson et al. . | |
| 5,088,717 | 2/1992 | Hamanaka et al. . | |
| 5,125,638 | 6/1992 | Ballestrazzi et al. . | |
| 5,183,241 | 2/1993 | Torisawa . | |
| 5,255,905 | 10/1993 | Reid et al. . | |

*Primary Examiner*—H. Grant Skaggs
*Attorney, Agent, or Firm*—Hill, Steadman & Simpson

[57] ABSTRACT

A feeding mechanism for flat flexible items is provided having a hopper for receiving a stack of the items, a rotatable cylindrical member positioned to engage a lowermost item of the stack with an outer circumferential surface thereof, a motor for rotationally driving the cylindrical member, a source of vacuum connected to the cylindrical member, at least one vacuum port extending through the outer surface of the cylindrical member which communicates with the vacuum source to provide a vacuum at the port, a high friction surface at the outer surface adjacent to the vacuum port, at least one belt carried on the cylindrical member so as not to protrude above the outer surface through a portion of the circumference, the belt also being captured on a pulley member such that the belt extends away from the cylindrical member on a side opposite the portion, at least one pressing roller for pressing against the outer surface of the cylindrical member at the portion. The item is drawn from the stack when the vacuum port and high friction area are rotated into engagement with the item. The item is carried into a nip between the cylindrical and the pressing roller which continues a driving of the item. The item is carried into contact with the belt where the belt begins to extend away from the cylindrical member and at that point the item is stripped from the cylindrical member and vacuum port and is carried by the belt.

20 Claims, 5 Drawing Sheets

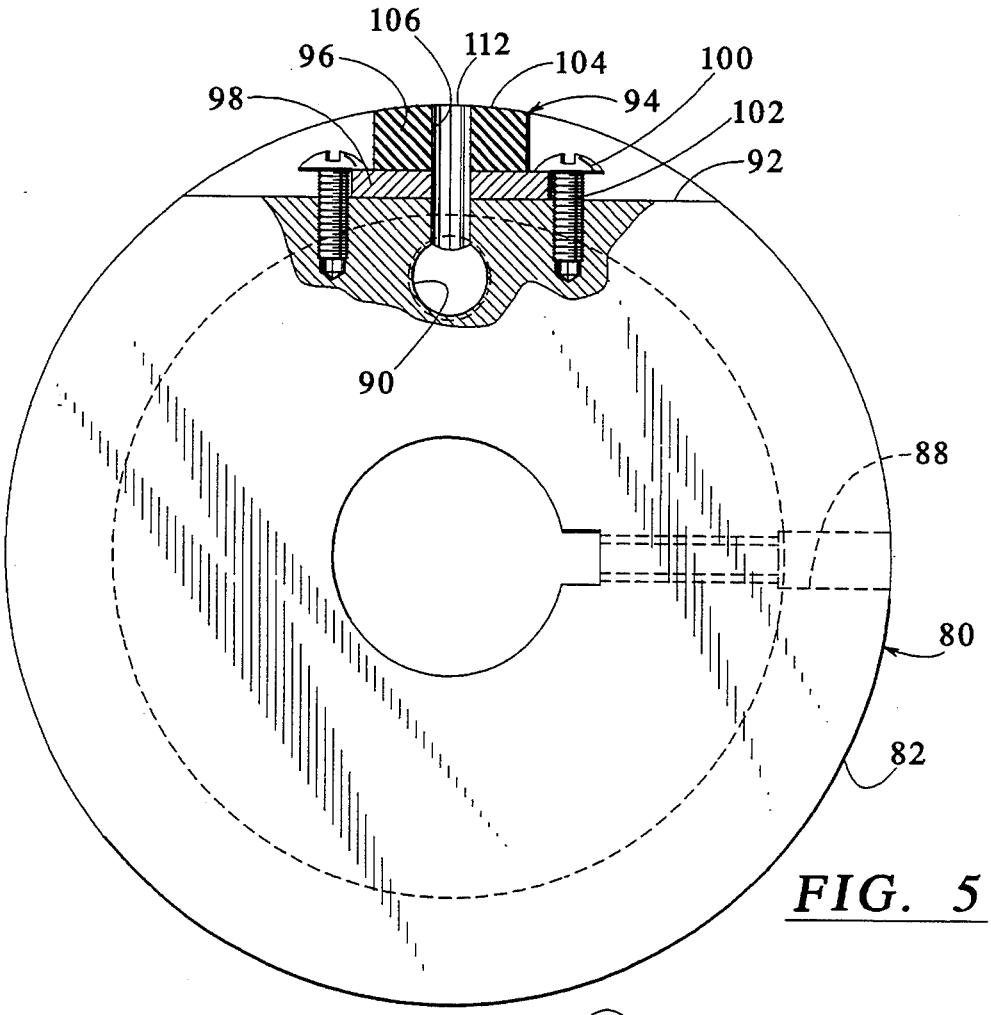
FIG. 5
FIG. 6
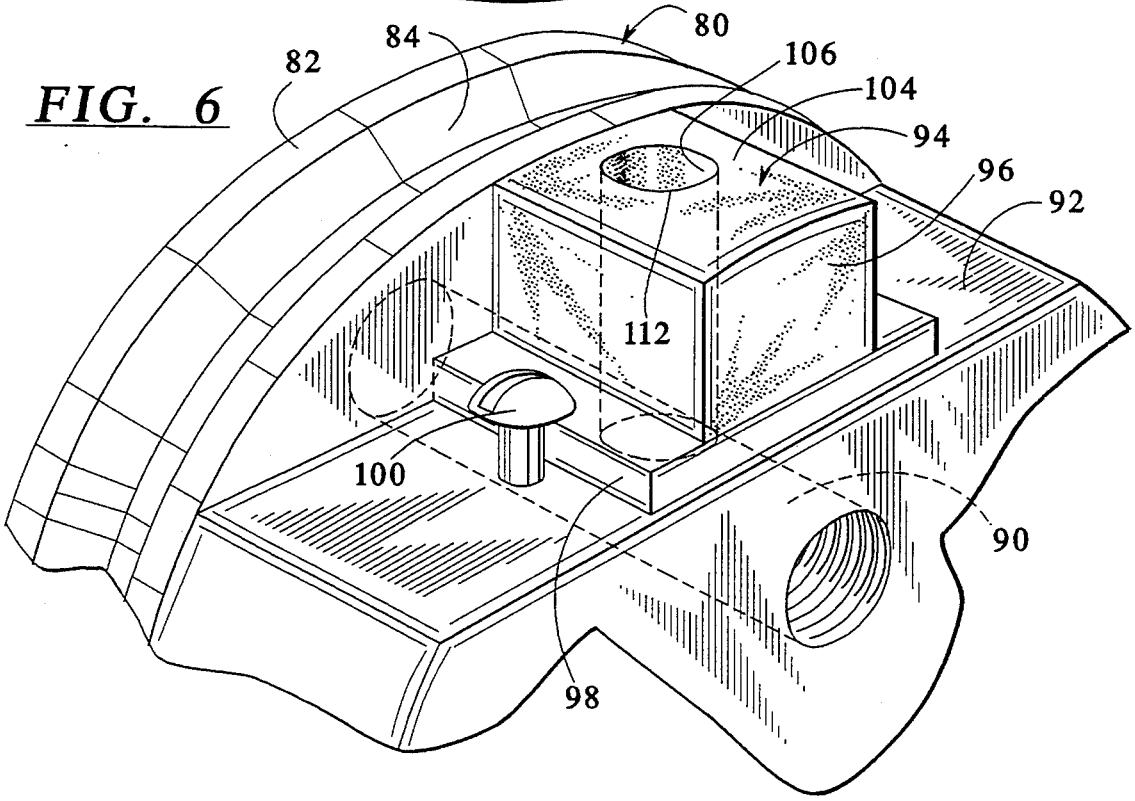

FIG. 7
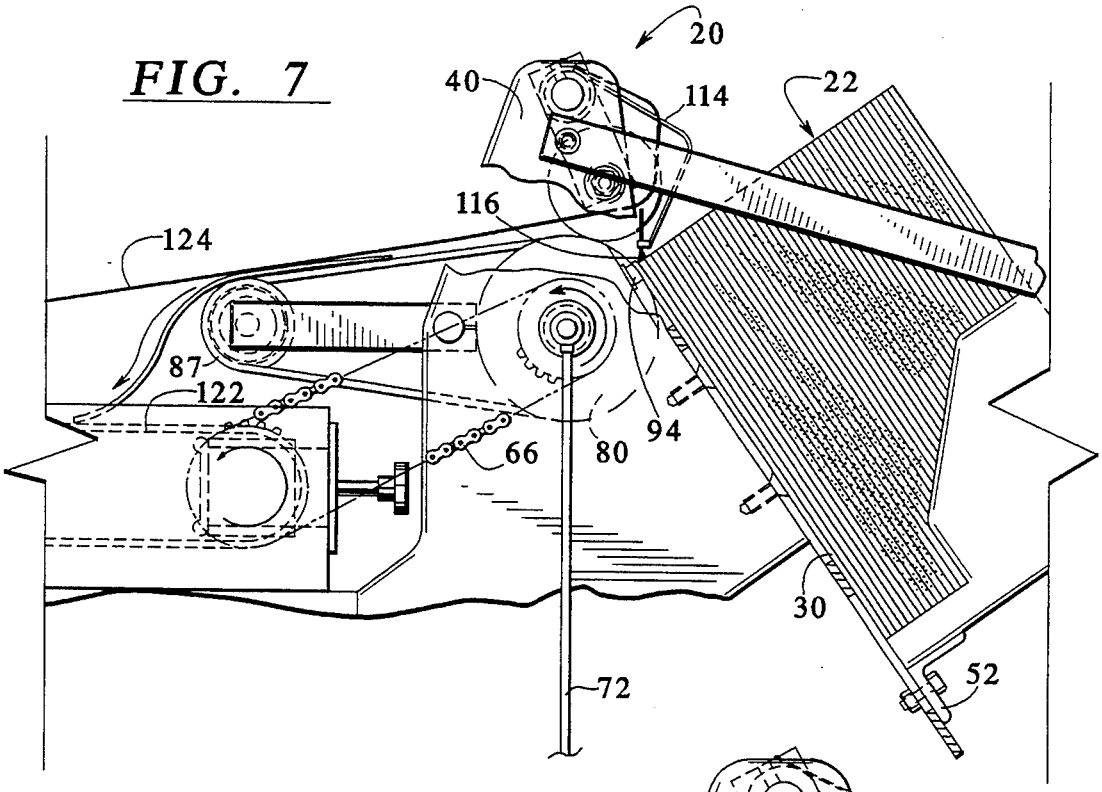
FIG. 8
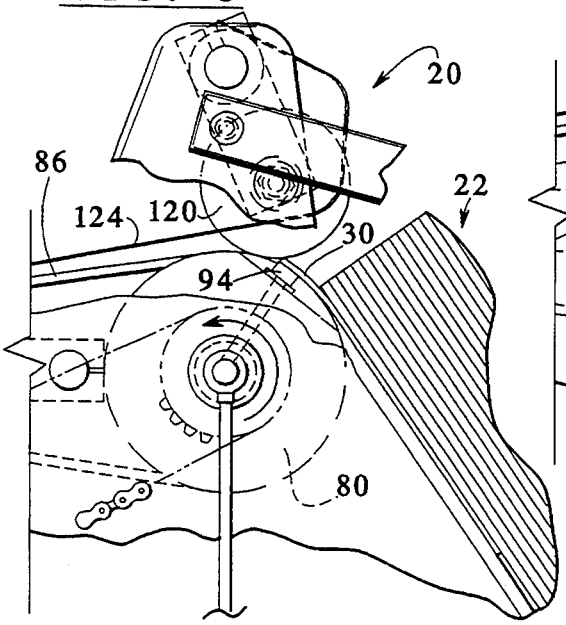
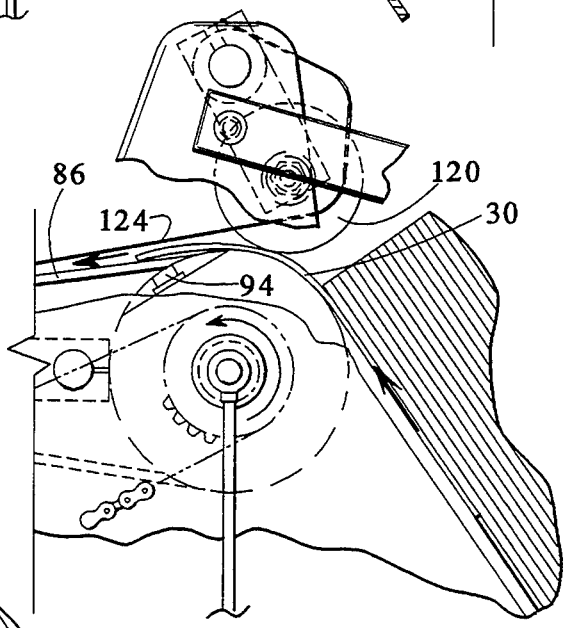
FIG. 9

FEEDING MECHANISM

BACKGROUND OF THE INVENTION

This invention relates to a feeding mechanism and more particularly to a mechanism for feeding flat objects such as bags, file folders, x-ray jackets, heavy paper etc. by use of a vacuum assisted feeding device.

Many types of devices are known for feeding flat objects such as sheets of paper, plates, bags, etc. in which a rotating cylinder, supplied with holes through a surface of the cylinder and being connected to vacuum suction, is used to separate a single item from a stack of items for transport. Oftentimes valves and other arrangements are utilized to turn the suction on and off as the cylinder rotates and/or the cylinder is periodically stopped from rotating in order to provide a gripping force and to remove the gripping force as the item is moved by the cylinder.

For example, in U.S. Pat. No. 5,088,717 a cylinder unit is provided having an outside pipe member with a plurality of small through holes. The outer surface of the outer pipe member is covered by a synthetic rubber. An internal, middle pipe member has openings through an angle $\alpha$ said in the range of 10°–80°. A third internalmost pipe member is provided with openings through an angle $\beta$ in the range of 10°–80°. By selectively rotating the concentric cylindrical member members, suction is alternatively provided or not provided at the outermost pipe. Also this patent teaches to not rotate the cylinders in a continuous manner, but in fact to stop the rotation in order to draw an item by suction into engagement with the stationary cylinder before suction is applied and rotation resumes. Further, an air blast device is used to remove a part of the weight of the stack of items from the item in engagement with the rotating cylinder.

U.S. Pat. No. 3,998,449 discloses a rotatable cylinder which has vacuum ports therethrough and also has a protuberance in the form of an elongated bar which extends above the cylindrical surface for engaging and dislodging an item from a stack. Again, the vacuum is selectively applied and removed from the vacuum ports such that suction is applied at the outer surface of the cylinder only intermittently.

U.S. Pat. No. 4,184,670 also discloses intermittent provision of suction as well as intermittent rotation of the cylinder and U.S. Pat. No. 4,758,126 also discloses intermittent provision of suction.

U.S. Pat. No. 5,255,905 discloses the use of a stationary vacuum device which is intermittently operated in connection with a conveyor. Air knife jets are also used to separate documents in a stack from which the bottommost document is being withdrawn by the conveyor.

U.S. Pat. No. 5,125,638 discloses the use of pivotally mounted sucker members carried on a rotatable cylinder which operate intermittently to engage a sheet and draw it toward the cylinder. A pivoting presser wheel presses the sheet against the cylinder and the vacuum at the sucker member is released causing the sheet to be carried along between the presser roller and a conveyor belt.

SUMMARY OF THE INVENTION

The present invention provides for an improved feeding mechanism for feeding flat objects such as bags, file folders, x-ray jackets and other similar types of flexible yet somewhat rigid items.

Although the present invention can be used to feed paper, it is best suited for heavy paper, greater than 20 pound stock. The items must be flexible enough to bend and follow the contour of the rotating cylinder. The flat items are positioned in a stack in a hopper such that the items are held in place by gravity, although the hopper is tilted sufficiently from vertical so as to relieve a substantial amount of the weight of the stack from the bottommost item.

A continuously rotating cylinder is provided adjacent to the bottom item in the stack, with the cylinder being supplied with a source of vacuum. A plurality of laterally adjustable wheels are carried on the rotating cylinder, which wheels are supplied with vacuum ports and are connected by conduits to the source of vacuum. The circumference of the wheels is positioned such as to be in contact with the bottommost item to be removed from the stack. The wheels are provided with a recessed area in which is located the vacuum port which extends through a rubber bumper which has an upper surface flush with the outer surface of the cylinder. Thus, the vacuum port has a small rubber surface (high friction surface) surrounding it to assist in obtaining gripping engagement with the item to be removed while the remainder of the cylinder is relatively smooth with a surface having a low coefficient of friction.

As the cylinder rotates, the vacuum port and rubber bumper will come into engagement with the lowermost item in the stack and will cause the lowermost item to begin moving upwardly out of the stack. The combination of the vacuum and the surrounding rubber or high friction surface will assure a good gripping of the item being removed. As the item moves away from the stack, it is drawn into a pinch point between the rotating cylinder and a presser roller which will assure that the item continues to be pulled along with the rotating cylinder. As the item continues to be drawn along, it engages a belt which is carried by the rotating cylinder in a flush or recessed manner along a portion of the circumference of the cylinder. The belt is also carried on a pulley so that it extends away from the cylinder on a side opposite the flush area. The vacuum port will begin to rotate away from the belt surface, thus releasing the effect of the vacuum on the item. From this point, the item will be pulled along by the rotating cylinder and pressing roller as well as by the belt itself.

Thus, the rotating cylinder rotates continuously and without intermittent movement and the suction to the vacuum ports is applied continuously without the need for special valves or other timing arrangements. Also, the pressing roller is continuously positioned against the rotating cylinder further reducing the complexity of the overall feeding device and avoiding the need for the use of any cams, solenoids or other periodic moving devices.

BRIEF DESCRIPTION OF THE DRAWINGS

FIG. 5 is a side elevational view partially in section, of a vacuum wheel carried on the rotating cylinder.

FIG. 6 is a partial perspective view of the vacuum wheel of FIG. 5.

FIG. 7 is a partial side elevational view showing the feeding device engaging a leading edge of a bottommost item in the stack.

FIG. 8 is an enlarged partial view of the feeding device illustrating the leading edge being introduced to the pinch point between the rotating vacuum wheel and the pressing roller.

FIG. 9 is an enlarged partial side elevational view illustrating the removed item being stripped from the vacuum port by the conveyor belt.

DETAILED DESCRIPTION OF THE PREFERRED EMBODIMENTS

Figure 1:
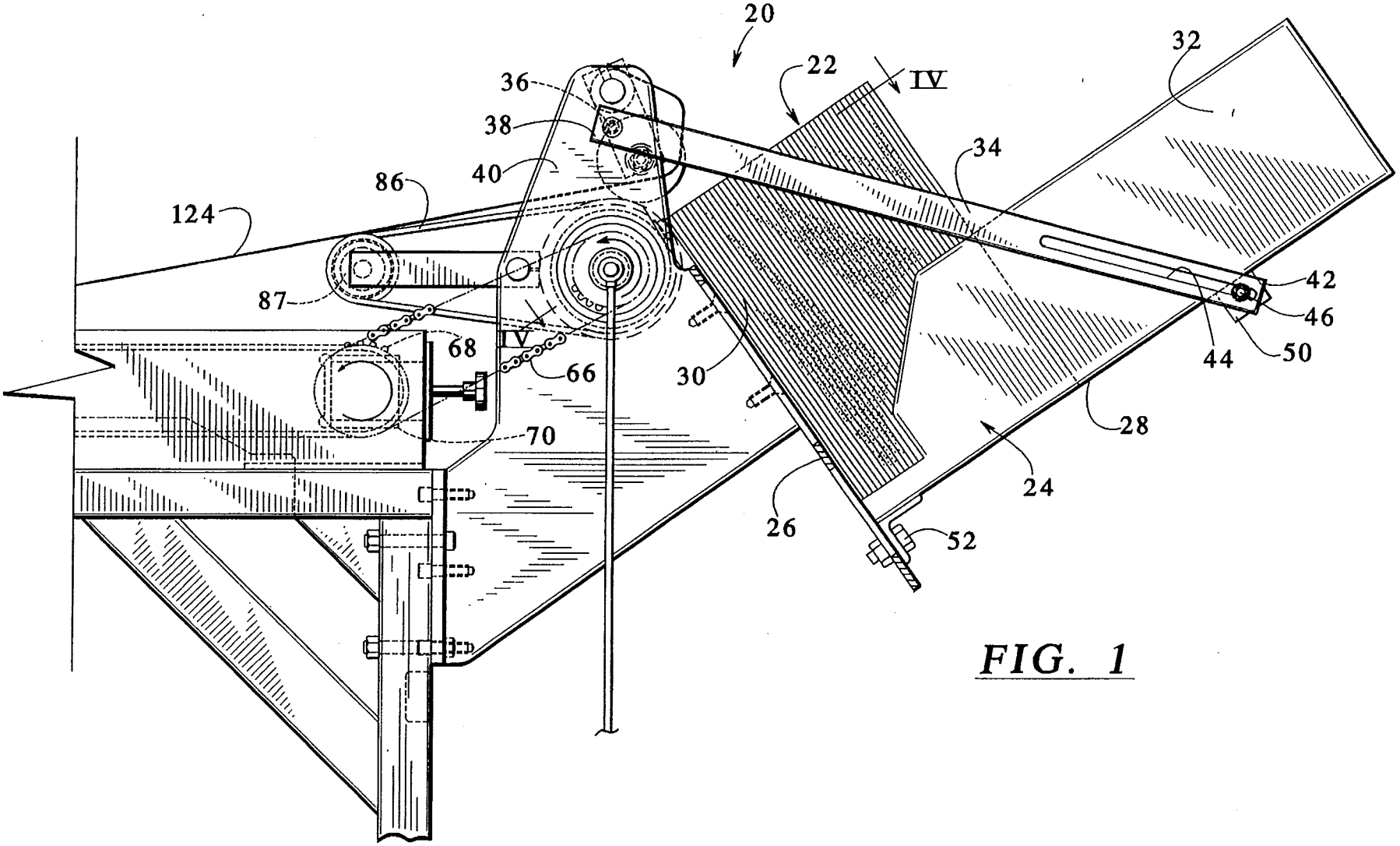
FIG. 1 is a side elevational view of a feeding device embodying the principles of the present invention.

In FIGS. 1-4 there is illustrated a feeder mechanism generally at 20 for feeding bags, file folders, x-ray jackets and other flat objects. A stack 22 of such items is positioned in a loading hopper 24. The loading hopper 24 has a bottom wall 26 and a rear wall 28 which is movably secured perpendicular to the bottom wall. The chute is angled from vertical quite substantially so that the weight of the stack of items 22 is carried both by the bottom wall 26 and the rear wall 28. In fact, in a preferred embodiment, the rear wall 28 is angled from horizontal less than the bottom wall 26 so that a majority of the weight of the stack of items 22 is borne by the rear wall 28. In this manner, only a small portion of the weight of the stack 22 will press against a bottommost item 30 in the stack 22. Sidewalls 32 are provided which extend perpendicularly to the rear wall 28 to assist in maintaining the stack of items 22 in alignment within the chute. At least one of the sidewalls is movably attached to the rear wall 28 to accommodate different sized items as will be explained in greater detail below.

The hopper 24 is supported by a pair of straps 34 which are pivotally secured at 36 at a first end 38 to a portion of a frame 40 for the feeding mechanism 20. A second end 42 of the straps 34 has an internal longitudinal slot 44 within which is received a threaded bolt 46. The bolt 46 which is secured to a cross member 48 (FIG. 2) which carries a number of blocks 50 engaging and supporting the rear wall 28 of the hopper 24. As shown in FIG. 3, the hopper 24 may be moved through a range of positions to accommodate different width items to be loaded by the feeder. In changing the position of the hopper, the position of the bottom wall 26 remains fixed while the rear wall 28 is moved. An angled bracket 52 is movably secured to the bottom wall 26 by means of an appropriate fastener 54 such as a bolt slidably received in a slot 55 such that the bracket will provide support for a bottom edge of the rear wall 28 at a selected position along the bottom wall 26. FIG. 3 shows the rear wall 28 in a lowermost position in full lines, at an intermediate position 28' in a light phantom line and in a highest position, for feeding the smallest width items at 28'' in heavy phantom lines. The position of the bracket 52 is also shown at the intermediate position 52' and the uppermost position 52''. As the rear wall 28 is moved upwardly, the fastener 46 extending through the slot 44 in the straps 34 is selectively untightened and moved to provide appropriate support to the wall in an intermediate position as at 46' and at the upper position as at 46''. The pivotable connection 36 of the straps 34 accommodates this movement of the straps and of the fastener 46.

Figure 2:
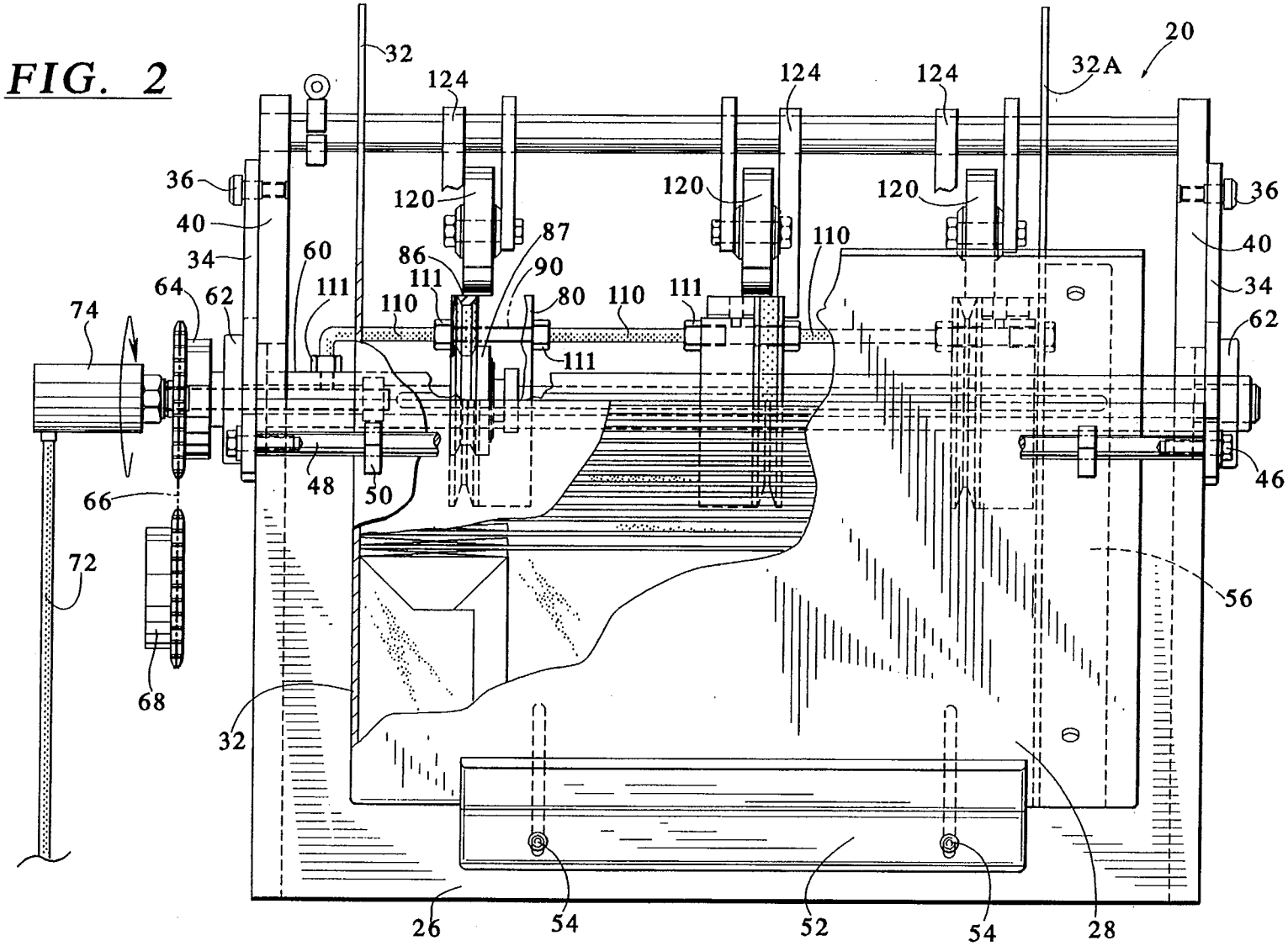
FIG. 2 is en elevational view of the device of FIG. 1 taken from the right side of FIG. 1.
Figure 3:
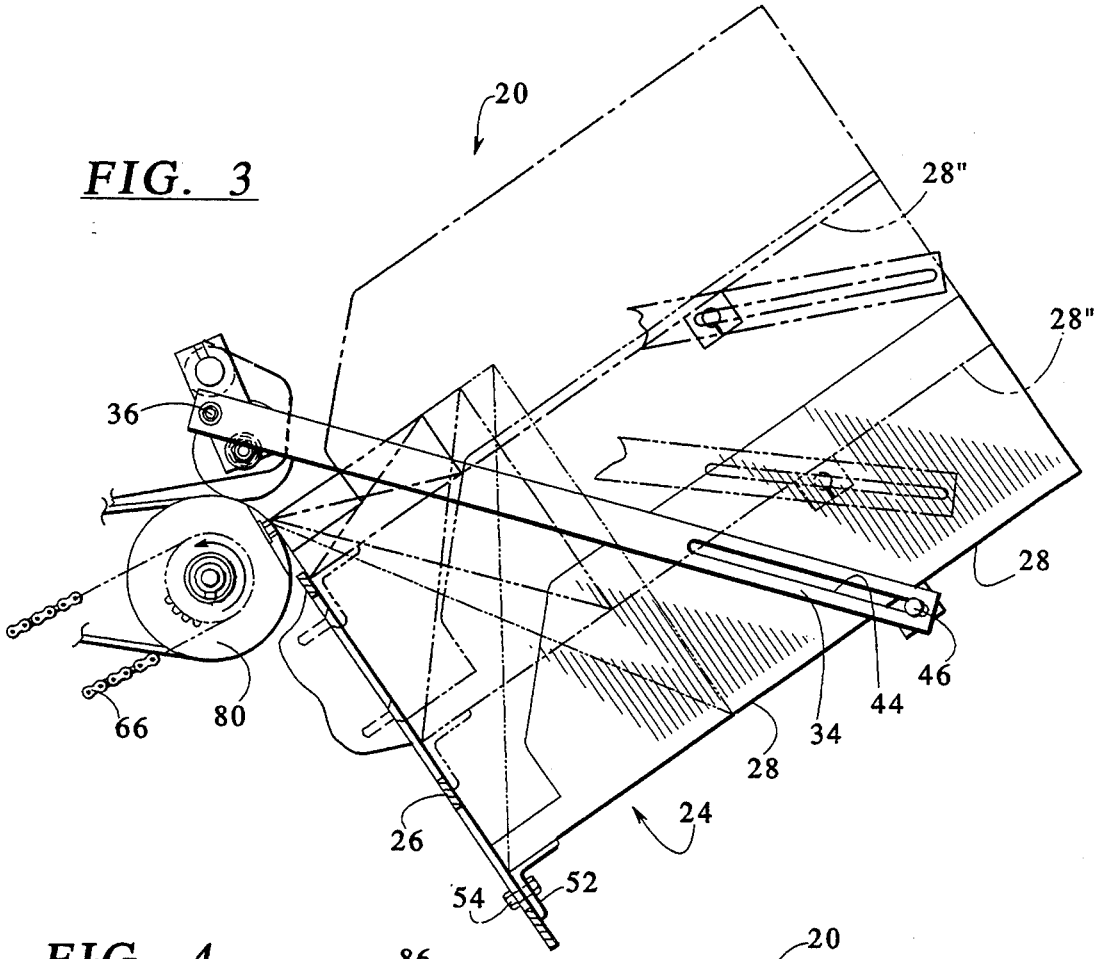
FIG. 3 is a partial side elevational view showing a range of positions for the feed hopper.
Figure 4:
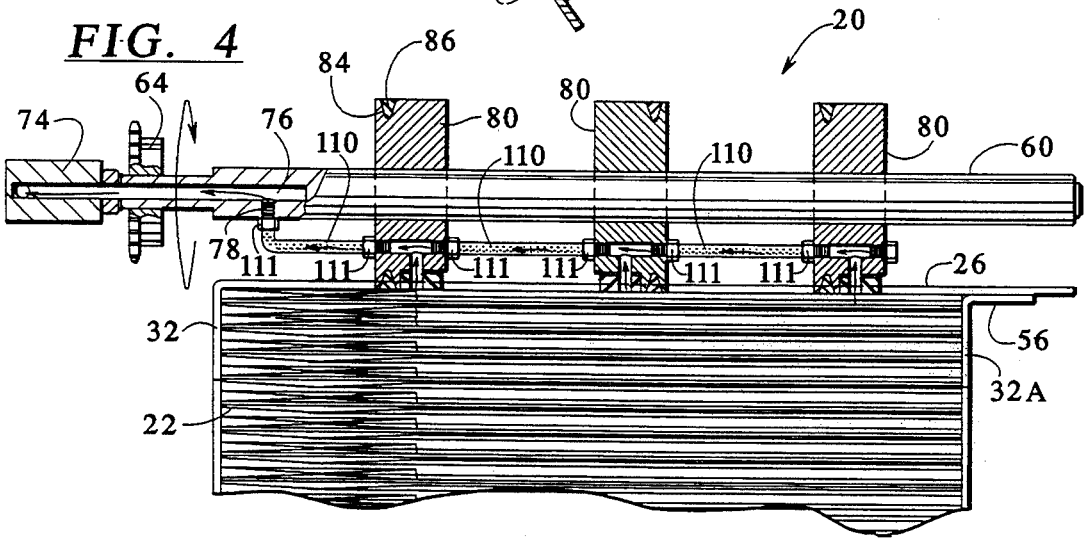
FIG. 4 is a sectional view taken generally along the line IV—IV of FIG. 1.

As best seen in FIG. 2, at least one sidewall 32A is secured to the rear wall 28 by means of a flange 56 which is removably secured to the rear wall 28. The sidewall 32A can be moved laterally and secured in selected lateral positions to accommodate items of different heights. Thus, by movement of the sidewall 32A and the rear wall 28, items having a height and width throughout a wide range can be accommodated by the feeder.

To dislodge and feed the lowermost item 30 in the stack 22, there is provided a rotating cylinder 60 which is journaled in bearings 62 mounted in the frame 34 at each side of the feeder 20. At one side of the feeder 20 a sprocket wheel 64 is secured to the cylinder 60 to rotate therewith. The sprocket wheel 64 is connected by means of a chain 66 to a second sprocket wheel 68 which is connected to a drive shaft of a motor 70. The motor 70 may also be located at a different position, so long as it is drivingly connected to the cylinder. As seen in the orientation of FIG. 1, the cylinder 60 is rotated in a counter clockwise direction.

A vacuum line 72 is connected to a rotary coupling 74 which in turn is connected to the cylinder 60 so as to communicate with an axial passage 76 formed in one end of the cylinder 60. A radial passage 78 provides communication between the axial passage 76 and a peripheral surface of the cylinder 60.

Carried on the shaft 60 is at least one, and preferably a plurality of vacuum wheels 80 (see also FIGS. 5 and 6). The vacuum wheels 80 have a cylindrical outer surface 82 and have a groove 84 formed in the outer peripheral surface for receiving a belt 86. The belt 86 is maintained in a flush or recessed position relative to the vacuum wheel throughout a portion of the circumference of the wheel 80. The belt 86 is also carried on a pulley 87 such that the belt will extend away from the cylinder 60 at a side opposite the portion where it is flush or recessed.

The vacuum wheels 80 can be selectively positioned along the length of the cylinder 60 and can be secured in a fixed position along the length by means of setting an appropriate set screw (not shown) which extends through a passage 88 formed in each vacuum wheel 80 and which is received in a groove (not shown) formed in the cylinder 60. Since most of the force acting between the vacuum wheels 80 and the cylinder 60 is a resistance to co-rotation, the provision of the groove for receipt of the set screws assures that there will not be slippage of the vacuum wheels 80 on the cylinder 60. Lateral forces on the wheels 80 relative to the cylinders are relatively minor and the engagement of the set screws into the grooves is sufficient to overcome any such forces.

Secondly, and most importantly, the use of the groove and set screws allows for a consistent alignment of the vacuum wheels 80 on the cylinder 60 such that each of the vacuum wheels will be maintained in a preselected angular position. This is necessary in that each of the vacuum wheels is provided with a vacuum port as described below which requires that each of the vacuum wheels maintain constant angular alignment with the other vacuum wheels.

As best shown in FIGS. 5 and 6 each of the vacuum wheels 80 has a longitudinal passage 90 formed therethrough which is parallel to but offset from an axis of rotation of the wheel. Radially outward from the passage 90, the wheel is formed with a flat area 92 forming a chord across a part of the width of the wheel 80.

Mounted on this flat area 92 is a bumper 94 which, in a preferred embodiment, comprises a rubber or elastomeric member 96 having a relatively high coefficient of friction. This elastomeric member 96 is secured to a plate 98 by appropriate means, such as an adhesive, with the plate 98 extending laterally to a greater degree than the elastomeric member 96. A pair of large headed screws 100 are threaded into apertures 102 in the flat area 92 directly adjacent to the plate 98 such that the heads will engage and capture the plate and clamp the plate against the flat area 92. A top surface 104 of the elastomeric member 96 preferably is flush with the cylindrical outer surface 82 of the vacuum wheel 80 such that it does not extend above, nor is it recessed below the circumferential surface of the wheel.

A radial passage 106 is formed through the elastomeric member 96, the plate 98 and the wheel 80 to intersect with the lateral passage 90 extending through the wheel. The passages 106 and 90 are connected by means of conduits 110 and appropriate couplings 111 to the radial passage 78 in the cylinder 60 leading to the axial passage 76 which communicates with the vacuum source. If the vacuum wheels 80 are to be moved along the axis of the cylinder closer to each other or farther apart, it is only the simple matter of replacing the connecting conduits 110 with appropriate length conduits and no other changes are necessary or required. Alternately, sufficient slack may be provided in the conduits 110, such as by wrapping them around the cylinder, to allow axial movement of the wheels 80 on the cylindrical member.

Thus, during operation of the feeder, as the cylinder rotates, vacuum is continuously supplied to a port 112 on the face 104 of the elastomeric members 96 at each vacuum wheel 80.

Operation of the feeder 20 is illustrated in FIGS. 7–9. In FIG. 7 the cylindrical member 60 and thus the vacuum wheel 80 has been rotated to a position where the bumper 94 has engaged and has begun to dislodge the lowermost item 30 in the stack 22. The combination of the vacuum suction and the high coefficient of friction in the surface surrounding the vacuum port 112 assures a good gripping of the item 30. In a preferred embodiment a retarding device 114 may be secured by an appropriate clamping arrangement to the frame 40 to extend into engagement with a leading edge of at least some of the lower items in the stack. Preferably a lower edge 116 of the retarding device is flexible to allow some movement thereof, yet is sufficiently rigid to prevent or greatly retard movement: of items above the bottom edge 116. For example, a bristled brush has been utilized with the end of the bristles just coming into contact with the lowermost item 30 so that it will be pulled past the very slight retarding action of the brush bristles, yet the next item thereabove will be more severely retarded by the brush bristles and will be held in place and will not be drawn along with the lowermost item.

As the vacuum wheel 80 rotates in a counter clockwise direction, the lowermost item 30 is lifted upwardly from the stack 22 and, as seen in FIG. 8, is caused to conform to the outer surface 82 of the vacuum wheel as the vacuum wheel rotates away from the stack. As the vacuum wheel continues to rotate, the lowermost item 30 is brought into contact with a pressing roller 120 which presses against the vacuum wheel 80 and thus creates a pinch point for continuing the driving of the lowermost item 30. Preferably an outer surface of the presser roller 120 is elastomeric so that it will allow the item to be drawn into the nip or pinch point.

As the vacuum wheel 80 continues to rotate towards the position shown in FIG. 9, a lower surface of the item 30 will engage with the conveyor belts 86 carried on the vacuum wheel 80 which will strip the item 30 away from the bumper 94 and its vacuum port 112, thereby causing the roller: 20 pressing against the rotating vacuum wheel 80 to be the sole driving means for the item 30. As the vacuum wheel 80 continues to rotate, the item 30 will be completely removed from the stack 22 and, once it has passed through the nip between the roller 120 and the vacuum wheel 80, it will be carried along solely by the belts 86 as shown in the left side of FIG. 7 from where it will be deposited onto another means of transport, such as a lug conveyor 122.

A hold down device 124, which may be in the form of a spring steel strap, again secured by means of an appropriate bracket to the frame 40 may be positioned above the belt 86 to prevent the items from lofting or being thrown or carried away from engagement with the belt 86, such as by air currents or by the items own aerodynamic reaction in passing through the air.

As the vacuum wheel continues to rotate, since the outer circumferential surface 82 of the wheel is relatively smooth and has a low coefficient of friction, in all areas except tile bumper which is adjacent to the vacuum port 112, the wheel 80 will be free to rotate against the next lowest item in the stack, without dislodging that item, until the bumper 94 has been rotated to a position to again contact and pickup the next item. In this manner an appropriate spacing between selected items from the stack will be maintained without the need for intermittently operating the cylinder or the vacuum supply.

Thus, since the motor 70 is operated continuously and the cylinder is rotated continuously, no special clutches or other mechanical or electrical controls or devices are needed to operate on the motor/cylinder system and the continuous operation provides considerably less wear and tear on the parts than if intermittent operation was occurring.

Further, since a continuous vacuum is provided at the port 112 in the bumper 94, no special valves or rotating seals and other complicated arrangements are required which typically would increase the complexity and therefore the cost and maintenance requirements of the system.

Nevertheless, by providing the bumpers 94 with the high coefficient of friction surface area only immediately surrounding the vacuum port 112, an intermittent feeding of the items from the stack will be achieved, thus assuring appropriate spacing between successively fed items.

The exact number and lateral placement of the vacuum wheels, the pressing rollers 120, the hold down straps 124 and the belts 86, may be modified as desired and as the requirements of the particular application dictate. With longer or heavier items more wheels may be necessary and with shorter or lighter items fewer wheels may be acceptable. Generally it is necessary that the pressing rollers 120 be aligned with and press against the vacuum wheels 80 to provide the driving nip therebetween. The straps can be laterally adjusted and need not be placed directly in alignment with the belts 86.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A feeding mechanism for flat flexible items, comprising:

a hopper for receiving a stack of said items;

a rotatable cylindrical member positioned to engage a lowermost item of said stack with an outer circumferential surface, thereof;

means for rotationally driving said cylindrical member arrange to drive said cylindrical member at a constant rotational speed;

a source of vacuum connected to said cylindrical member;

at least one vacuum port extending through said outer surface of said cylindrical member which communicates with said vacuum source to provide a vacuum at said port;

a high friction surface at said outer surface adjacent to said vacuum port;

at least one belt carried on said cylindrical member so as not to protrude above said outer surface through a portion of said circumference, said belt also being captured on a pulley member such that said belt extends away from said cylindrical member on a side opposite said portion;

at least one pressing means for pressing against said outer surface of said cylindrical member at said portion.

2. A feeding mechanism according to claim 1, wherein said a source of vacuum connected to said cylindrical member is arranged to provide a constant vacuum to said cylindrical member.

3. A feeding mechanism according to claim 1, wherein said high friction surface is substantially flush with said outer surface.

4. A feeding mechanism according to claim 1, wherein said high friction surface is limited to an area adjacent to said vacuum port.

5. A feeding mechanism according to claim 1, wherein said cylindrical member outer surface has a low friction surface at areas other than adjacent to said vacuum port.

6. A feeding mechanism according to claim 1, including at least one hold down means positioned above said belt at least in the area where it extends away from said cylindrical member.

7. A feeding mechanism according to claim 1, including means for retarding movement of at least one item above said lowermost item.

8. A feeding mechanism according to claim 1, including means at said hopper to permit said hopper to accommodate items of different lengths and widths throughout a preselected range.

9. A feeding mechanism according to claim 8, wherein said means at said hopper comprise movable walls of said hopper.

10. A feeding mechanism according to claim 1, wherein said hopper is positioned at an angle such that a majority of the weight of said items in said stack is not pressing against said lowermost item.

11. A feeding mechanism according to claim 1, wherein said at least one pressing means comprises a roller continuously pressed against said outer surface of said cylindrical member at said portion.

12. A feeding mechanism according to claim 1, wherein said means for rotationally driving said cylindrical member comprises a motor having an output shaft drivingly connected to said cylindrical member.

13. A feeding mechanism for flat flexible items, comprising:

a hopper for receiving a stack of said items;

a rotatable cylindrical member positioned to engage a lowermost item of said stack with an outer circumferential surface thereof;

means for rotationally driving said cylindrical member;

a source of vacuum connected to said cylindrical member;

at least one vacuum port extending through said outer surface of said cylindrical member which communicates with said vacuum source to provide a vacuum at said port;

a high friction surface at said outer surface adjacent to said vacuum port;

at least one belt carried on said cylindrical member so as not to protrude above said outer surface through a portion of said circumference, said belt also being captured on a pulley member such that said belt extends away from said cylindrical member on a side opposite said portion;

at least one pressing means for pressing against said outer surface of said cylindrical member at said portion said at least one vacuum port extending through said outer surface of said cylindrical member which communicates with said vacuum source is provided with a constant level of vacuum suction at all rotational positions of said cylindrical member.

14. A feeding mechanism according to claim 13, wherein said means for driving said cylindrical member is arranged to drive said cylindrical member at a constant rotational speed.

15. A feeding mechanism for flat flexible items, comprising:

a hopper for receiving a stack of said items;

a rotatable cylindrical member positioned to engage a lowermost item of said stack with an outer circumferential surface thereof;

means for rotationally driving said cylindrical member;

a source of vacuum connected to said cylindrical member;

at least one vacuum port extending through said outer surface of said cylindrical member which communicates with said vacuum source to provide a vacuum at said port;

a high friction surface at said outer surface adjacent to said vacuum port;

at least one belt carried on said cylindrical member so as not to protrude above said outer surface through a portion of said circumference, said belt also being captured on a pulley member such that said belt extends away from said cylindrical member on a side opposite said portion;

at least one pressing means for pressing against said outer surface of said cylindrical member at said portion wherein said cylindrical member comprises a cylinder and a plurality of individual vacuum wheels carried on said cylindrical member, said vacuum wheels each having a passage therein communicating with said source of vacuum and said port being positioned at a circumferential surface of each of said wheels.

16. A feeding mechanism according to claim 15, wherein said vacuum wheels are adjustably positioned at a selected location along a length of said cylinder and means are provided to permit said wheels to be repositioned along said length and then resecured in a new selected position.

17. A feeding mechanism for flat flexible items, comprising:

a hopper for receiving a stack of said items;

a rotatable cylindrical member positioned to engage a lowermost item of said stack with an outer circumferential surface thereof;

means for driving said cylindrical member at a constant rotational speed;

a source of vacuum connected to said cylindrical member;

at least one vacuum port extending through said outer surface of said cylindrical member which communicates with said vacuum source to provide a constant level vacuum at said port at all rotational positions of said cylindrical member;

a high friction surface substantially flush with said outer surface limited to an area adjacent to said vacuum port; said cylindrical member outer surface having a low friction surface at areas other than adjacent to said vacuum port;

at least one belt carried on said cylindrical member so as not to protrude above said outer surface through a portion of said circumference, said belt also being captured on a wheel such that said belt extends away from said cylindrical member on a side opposite said portion; and at least one friction wheel secured to continuously press against said outer surface of said cylindrical member at said portion.

18. A feeding mechanism according to claim 17, further including at least one hold down means positioned above said belt at least in the area where it extends away from said cylindrical member.

19. A feeding mechanism according to claim 17, further including means for retarding movement of at least one item above said lowermost item.

20. A method for feeding flat flexible items, comprising:

stacking a supply of said items in a hopper;

positioning a rotatable cylindrical member to engage a lowermost item of said stack with an outer circumferential surface thereof;

rotationally driving said cylindrical member at a constant rotational speed;

connecting a source of vacuum to said cylindrical member; communicating at least one vacuum port extending through said outer surface of said cylindrical member with said vacuum source to provide a constant level of vacuum at all rotational positions of said port;

providing a high friction surface at said outer surface adjacent to said vacuum port;

providing at least one belt carried on said cylindrical member so as not to protrude above said outer surface through a portion of said circumference, said belt also being captured on a pulley member such that said belt extends away from said cylindrical member on a side opposite said portion;

providing at least one pressing means for pressing against said outer surface of said cylindrical member at said portion; whereby said lowermost item is removed from said stack by said rotating cylindrical member upon said vacuum port and high friction surface engaging said lowermost item, said item is carried past said pressing means which, in combination with said cylindrical member, continues to drive said item, and said item is removed from contact with said vacuum port by said belt as said item is carried into engagement with said belt at the location where said belt begins to move away from said cylindrical member.

* * * * *